US005953759A

United States Patent [19]

Bozzini

[11] Patent Number: 5,953,759

[45] Date of Patent: Sep. 21, 1999

[54] PANTY HOSE WITH DETACHABLE LEG PORTIONS

[76] Inventor: Albert J. Bozzini, 10 Llanfair Cir., Ardmore, Pa. 19003

[21] Appl. No.: 09/121,314

[22] Filed: Jul. 23, 1998

[51] Int. Cl.[6] ..... A41B 11/04

[52] U.S. Cl. ..... 2/409; 2/69; 2/239

[58] Field of Search ..... 2/239, 409, 69, 2/171, 240, 241, 242, 311, 312, 338, 919, 920, DIG. 11

[56] References Cited

U.S. PATENT DOCUMENTS

| | | | |
|---|---|---|---|
| 1,765,965 | 6/1930 | Cohen | 2/311 X |
| 1,833,163 | 11/1931 | Ischinger | 2/409 |
| 2,514,108 | 7/1950 | Vogt | 2/409 |
| 2,962,726 | 12/1960 | Wehrli | 2/311 X |
| 5,097,537 | 3/1992 | Ewing | 2/409 |
| 5,136,726 | 8/1992 | Kellin et al. | 2/171 |

*Primary Examiner*—Gloria Hale

[57] ABSTRACT

A panty hose with detachable leg portions for allowing replacement of legs when in need of replacement. The inventive device includes a panties portion comprised of a front panel and a rear panel. The front panel and the rear panel are joined together forming an upper waist portion and a pair of upper leg portions. Each of the upper leg portions have a decorative panel extending downwardly therefrom. An interior surface of the decorative panels have a hook and loop band extending therearound. A pair of leg portions are removably coupled with the panties portion. The pair of leg portions each have a hook and loop band extending around a periphery of an upper end thereof. The hook and loop bands of the legs portions mate with the hook and loop bands on the interior surface of the decorative panels to facilitate removable securement of the leg portions to the panties portion.

6 Claims, 2 Drawing Sheets

PANTY HOSE WITH DETACHABLE LEG PORTIONS

BACKGROUND OF THE INVENTION

1. Field of the Invention

The present invention relates to panty hose with detachable leg portions and more particularly pertains to a new panty hose with detachable leg portions for allowing replacement of legs when in need of replacement.

2. Description of the Prior Art

The use of stockings is known in the prior art. More specifically, stockings heretofore devised and utilized are known to consist basically of familiar, expected and obvious structural configurations, notwithstanding the myriad of designs encompassed by the crowded prior art which have been developed for the fulfillment of countless objectives and requirements.

Known prior art stockings include U.S. Pat. No. 5,027,441 to Wilson; U.S. Pat. No. 4,835,795 to Lonon; U.S. Pat. No. Des. 311,991 to Pippins; U.S. Pat. No. 4,951,321 to Mortensen et al.; U.S. Pat. No. 4,393,522 to Calabreses; and U.S. Pat. No. 4,502,158 to Mouri et al.

While these devices fulfill their respective, particular objectives and requirements, the aforementioned patents do not disclose a new panty hose with detachable leg portions. The inventive device includes a panties portion comprised of a front panel and a rear panel. The front panel and the rear panel are joined together forming an upper waist portion and a pair of upper leg portions. Each of the upper leg portions have a decorative panel extending downwardly therefrom. An interior surface of the decorative panels have a hook and loop band extending therearound. A pair of leg portions are removably coupled with the panties portion. The pair of leg portions each have a hook and loop band extending around a periphery of an upper end thereof. The hook and loop bands of the legs portions mate with the hook and loop bands on the interior surface of the decorative panels to facilitate removable securement of the leg portions to the panties portion.

In these respects, the panty hose with detachable leg portions according to the present invention substantially departs from the conventional concepts and designs of the prior art, and in so doing provides an apparatus primarily developed for the purpose of allowing replacement of legs when in need of replacement.

SUMMARY OF THE INVENTION

In view of the foregoing disadvantages inherent in the known types of stockings now present in the prior art, the present invention provides a new panty hose with detachable leg portions construction wherein the same can be utilized for allowing replacement of legs when in need of replacement.

The general purpose of the present invention, which will be described subsequently in greater detail, is to provide a new panty hose with detachable leg portions apparatus and method which has many of the advantages of the stockings mentioned heretofore and many novel features that result in a new panty hose with detachable leg portions which is not anticipated, rendered obvious, suggested, or even implied by any of the prior art stockings, either alone or in any combination thereof.

To attain this, the present invention generally comprises a panties portion comprised of a front panel and a rear panel. The front panel and the rear panel are joined together forming an upper waist portion and a pair of upper leg portions. The panties portion has a cotton crotch panel. The rear panel includes a backside panel. Each of the upper leg portions have a decorative panel extending downwardly therefrom. An interior surface of the decorative panels have a hook and loop band extending therearound. A pair of leg portions are removably coupled with the panties portion. The pair of leg portions each have a hook and loop band extending around a periphery of an upper end thereof. The hook and loop bands of the legs portions mate with the hook and loop bands on the interior surface of the decorative panels to facilitate removable securement of the leg portions to the panties portion. A plurality of decorative attachments are adapted for removable securement to the decorative panels of the panties portion. Each of the decorative attachments have a hook and loop patch disposed on a back surface thereof. A supplemental hook and loop band removably wraps around the decorative panels of the panties portion for securing the decorative attachments thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new panty hose with detachable leg portions apparatus and method which has many of the advantages of the stockings mentioned heretofore and many novel features that result in a new panty hose with detachable leg portions which is not anticipated, rendered obvious, suggested, or even implied by any of the prior art panty hose with detachable leg portions, either alone or in any combination thereof.

It is another object of the present invention to provide a new panty hose with detachable leg portions which may be easily and efficiently manufactured and marketed.

It is a further object of the present invention to provide a new panty hose with detachable leg portions which is of a durable and reliable construction.

An even further object of the present invention is to provide a new panty hose with detachable leg portions which is susceptible of a low cost of manufacture with regard to both materials and labor, and which accordingly is then susceptible of low prices of sale to the consuming public, thereby making such panty hose with detachable leg portions economically available to the buying public.

Still yet another object of the present invention is to provide a new panty hose with detachable leg portions which provides in the apparatuses and methods of the prior art some of the advantages thereof, while simultaneously overcoming some of the disadvantages normally associated therewith.

Still another object of the present invention is to provide a new panty hose with detachable leg portions for allowing replacement of legs when in need of replacement.

Yet another object of the present invention is to provide a new panty hose with detachable leg portions which includes a panties portion comprised of a front panel and a rear panel. The front panel and the rear panel are joined together forming an upper waist portion and a pair of upper leg portions. Each of the upper leg portions have a decorative panel extending downwardly therefrom. An interior surface of the decorative panels have a hook and loop band extending therearound. A pair of leg portions are removably coupled with the panties portion. The pair of leg portions each have a hook and loop band extending around a periphery of an upper end thereof. The hook and loop bands of the legs portions mate with the hook and loop bands on the interior surface of the decorative panels to facilitate removable securement of the leg portions to the panties portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
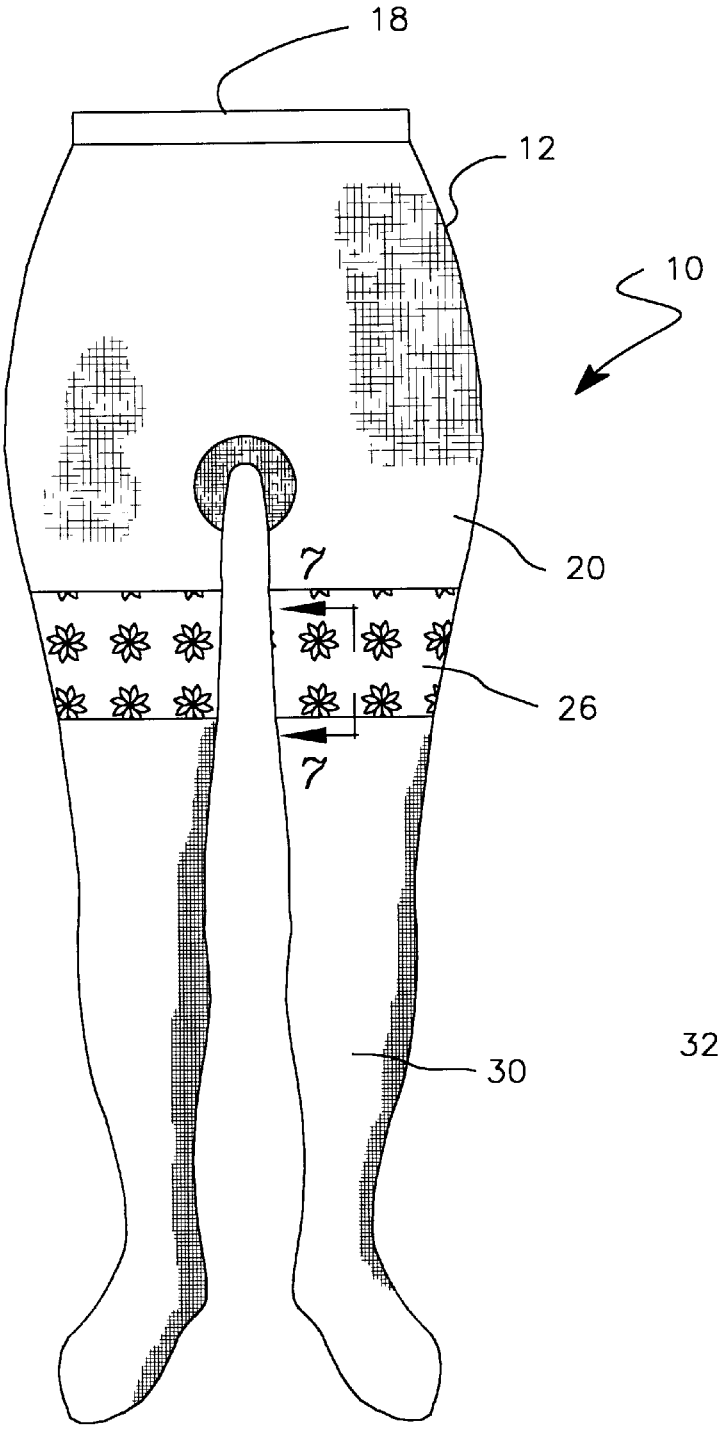
FIG. 1 is a front of a preferred embodiment according to the present invention.
Figure 2:
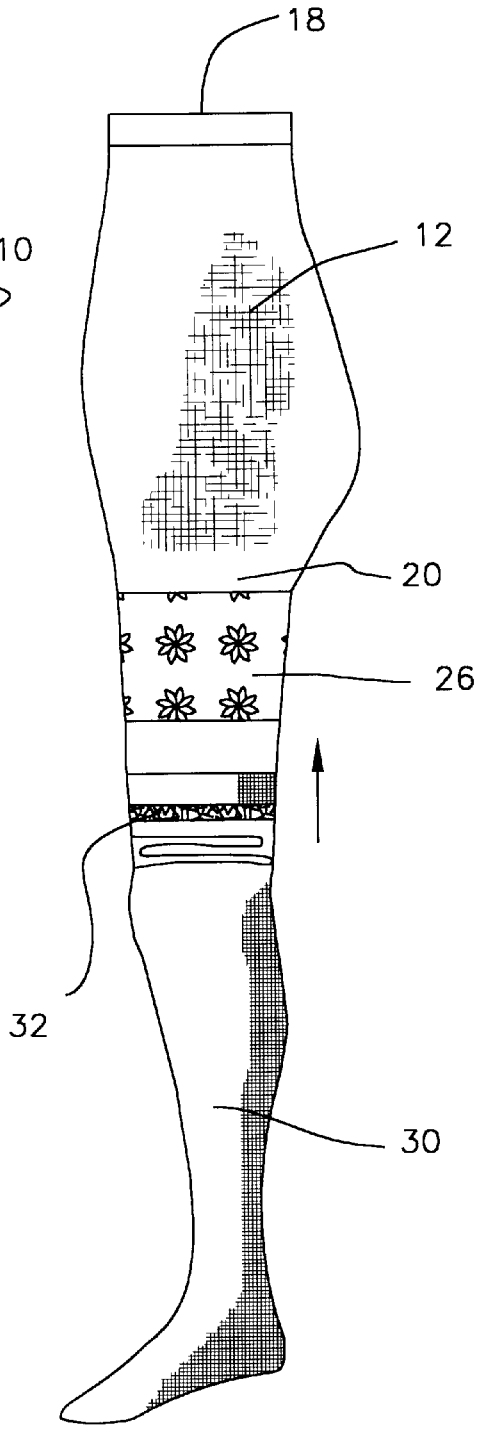
FIG. 2 is a side view of the present invention illustrating leg portions being secured to a panty portion.
Figure 3:
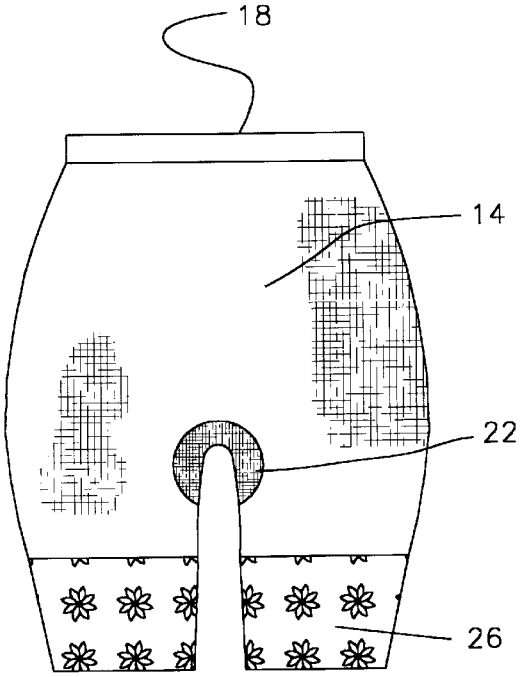
FIG. 3 is a front view of the panty portion of the present invention.
Figure 4:
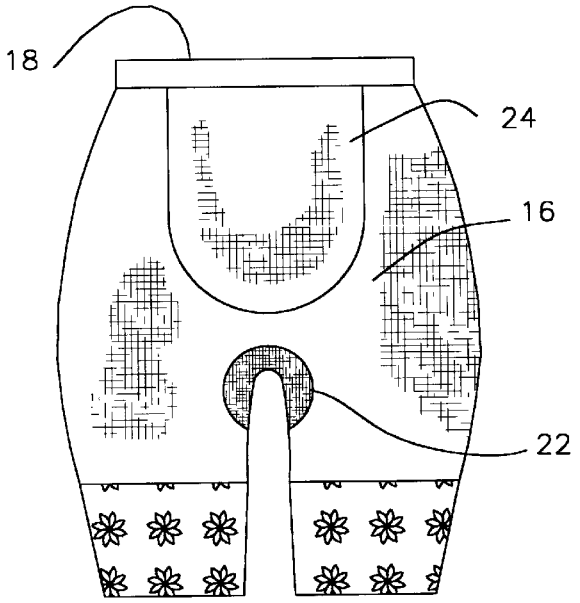
FIG. 4 is a rear view of the panty portion of the present invention.
Figure 6:
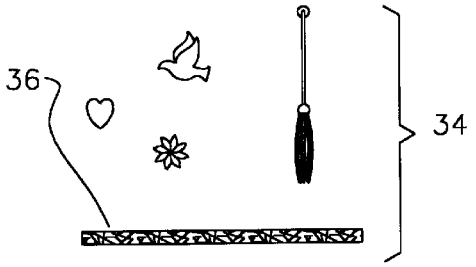
FIG. 6 is a front view of optional ornamental attachments of the present invention.
Figure 5:
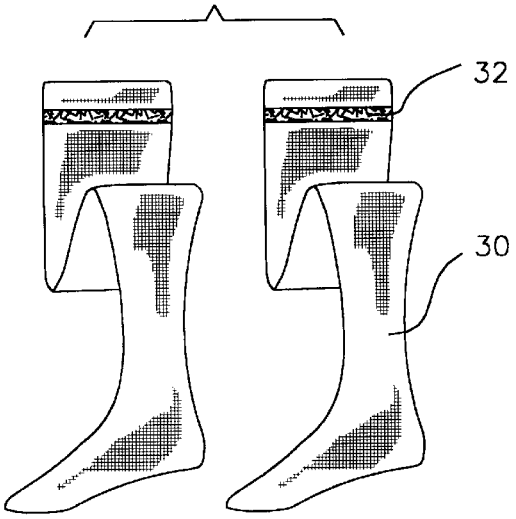
FIG. 5 is a front view of the leg portions of the present invention.
Figure 7:
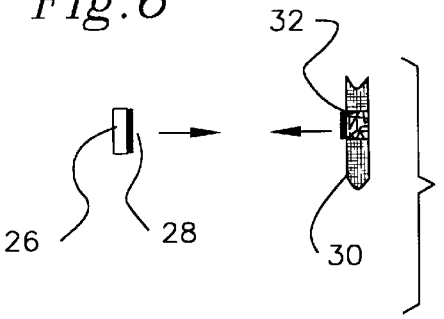
FIG. 7 is a cross-sectional view of the present invention as taken along line 7—7 of FIG. 1.

With reference now to the drawings, and in particular to FIGS. 1 through 7 thereof, a new panty hose with detachable leg portions embodying the principles and concepts of the present invention and generally designated by the reference numeral 10 will be described.

As best illustrated in FIGS. 1 through 7, the panty hose with detachable leg portions 10 comprises a panties portion 12 comprised of a front panel 14 and a rear panel 16. The front panel 14 and the rear panel 16 are joined together forming an upper waist portion 18 and a pair of upper leg portions 20. The panties portion 12 has a cotton crotch panel 22. The rear panel 16 includes a backside panel 24. Each of the upper leg portions 20 have a decorative panel 26 extending downwardly therefrom. An interior surface of the decorative panels 26 have a hook and loop band 28 extending therearound.

A pair of leg portions 30 are removably coupled with the panties portion. The pair of leg portions 30 each have a hook and loop band 32 extending around a periphery of an upper end thereof. The hook and loop bands 32 of the legs portions 30 mate with the hook and loop bands 28 on the interior surface of the decorative panels 26 to facilitate removable securement of the leg portions 30 to the panties portion 12.

A plurality of decorative attachments 34 are adapted for removable securement to the decorative panels 26 of the panties portion 12. Each of the decorative attachments 34 have a hook and loop patch disposed on a back surface thereof. The attachments 34 could resemble tassels, hearts, birds, flowers, etc.

A supplemental hook and loop band 36 removably wraps around the decorative panels 26 of the panties portion 12 for securing the decorative attachments 34 thereto.

In use, the present invention consists of a pair of panties 12 that are produced separately from the leg portions 30. Thus, if a run or snag occurred in one leg portion 30, only that leg portion 30 would need to be replaced instead of replacing the entire unit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A panty hose with detachable leg portions for allowing replacement of legs when in need of replacement comprising, in combination:

a panties portion comprised of a front panel and a rear panel, the front panel and the rear panel being joined together forming an upper waist portion and a pair of upper leg portions, the panties portion having a cotton crotch panel, the rear panel including a backside panel, each of the upper leg portions having a decorative panel extending downwardly therefrom, an interior surface of the decorative panels having a hook and loop band extending therearound;

a pair of leg portions removably coupled with the panties portion, the pair of leg portions each having a hook and loop band extending around a periphery of an upper end thereof, the hook and loop bands of the legs portions mating with the hook and loop bands on the interior surface of the decorative panels to facilitate removable securement of the leg portions to the panties portion;

a plurality of decorative attachments adapted for removable securement to the decorative panels of the panties portion, each of the decorative attachments having a hook and loop patch disposed on a back surface thereof; and a supplemental hook and loop band removably wrapping around the decorative panels of the panties portion for securing the decorative attachments thereto.

2. A panty hose with detachable leg portions for allowing replacement of legs when in need of replacement comprising, in combination:

a panties portion comprised of a front panel and a rear panel, the front panel and the rear panel being joined together forming an upper waist portion and a pair of upper leg portions, each of the upper leg portions having a decorative panel extending downwardly therefrom, an interior surface of the decorative panels having a hook and loop band extending therearound;

a pair of leg portions removably coupled with the panties portion, the pair of leg portions each having a hook and loop band extending around a periphery of an upper end thereof, the hook and loop bands of the legs portions mating with the hook and loop bands on the interior surface of the decorative panels to facilitate removable securement of the leg portions to the panties portion; and a plurality of decorative attachments adapted for removable securement to a band wrapping around the decorative panels of the panties portion.

3. A panty hose with detachable leg portions for allowing replacement of legs when in need of replacement comprising, in combination:

a panties portion comprised of a front panel and a rear panel, the front panel and the rear panel being joined together forming an upper waist portion and a pair of upper leg portions, each of the upper leg portions having a decorative panel extending downwardly therefrom, an interior surface of the decorative panels having a hook and loop band extending therearound;

a pair of leg portions removably coupled with the panties portion, the pair of leg portions each having a hook and loop band extending around a periphery of an upper end thereof, the hook and loop bands of the legs portions mating with the hook and loop bands on the interior surface of the decorative panels to facilitate removable securement of the leg portions to the panties portion; and a plurality of decorative attachments adapted for removable securement to the decorative panels of the panties portion, each of the decorative attachments having a hook and loop patch disposed on a back surface thereof adapted for engaging a hook and loop fastener on the decorative panels of the panties portion.

4. The panty hose with detachable leg portions as set forth in claim 3 wherein the hook and loop fastener comprises a hook and loop band removably wrapping around the decorative panels of the panties portion for securing the decorative attachments thereto.

5. The panty hose with detachable leg portions as set forth in claim 2 wherein the panties portion has a cotton crotch panel.

6. The panty hose with detachable leg portions as set forth in claim 2 wherein the rear panel of the panties portion includes a backside panel.

* * * * *